US009625128B2

(12) United States Patent
Lu

(10) Patent No.: US 9,625,128 B2
(45) Date of Patent: Apr. 18, 2017

(54) HIGH POWER TRI-PROOF LED LAMP

(71) Applicant: Xiamen PVTECH Co., Ltd., Xiamen, Fujian (CN)

(72) Inventor: Fuxing Lu, Fujian (CN)

(73) Assignee: Xiamen PVTECH Co., Ltd., Xiamen, Fujian (CN)

( * ) Notice: Subject to any disclaimer, the term of this patent is extended or adjusted under 35 U.S.C. 154(b) by 0 days.

(21) Appl. No.: 14/729,079

(22) Filed: Jun. 3, 2015

(65) Prior Publication Data

US 2016/0356460 A1 Dec. 8, 2016

(51) Int. Cl.

| | |
|---|---|
| ***F21V 19/04*** | (2006.01) |
| ***F21V 17/12*** | (2006.01) |
| ***F21K 99/00*** | (2016.01) |
| ***F21V 23/06*** | (2006.01) |
| ***F21V 23/02*** | (2006.01) |

(Continued)

(52) U.S. Cl.

CPC ..... *F21V 17/12* (2013.01); *F21K 9/17* (2013.01); *F21V 3/0436* (2013.01); *F21V 15/015* (2013.01); *F21V 23/023* (2013.01); *F21V 23/0464* (2013.01); *F21V 23/06* (2013.01); *F21V 29/89* (2015.01); *F21V 31/005* (2013.01); *F21Y 2103/003* (2013.01)

(58) Field of Classification Search

CPC ..... F21V 17/12; F21V 3/0436; F21V 15/015; F21V 23/023; F21V 23/0464; F21V 23/06; F21V 31/00; F21V 31/005; F21V 31/04; F21V 25/00; F21V 25/12; F21S 4/28

See application file for complete search history.

(56) References Cited

U.S. PATENT DOCUMENTS 7,303,310 B2 * 12/2007 You ..... F21S 8/031 362/219
2008/0037239 A1 * 2/2008 Thomas ..... F21S 4/008 362/92

(Continued)

*Primary Examiner* — Andrew Coughlin
*Assistant Examiner* — Alexander Garlen
(74) *Attorney, Agent, or Firm* — Winston Hsu; Scott Margo

(57) ABSTRACT

A high power Tri-proof LED lamp, comprises a lower PC cover, an upper aluminum cover and two end caps. Each end cap includes an inner end cap and an outer end cap. Said upper aluminum cover and lower PC cover are secured with the inner end cap by four inner end cap screws. The outer end cap is secured with the inner end cap by outer end cap screws. The tri-proof LED lamp in accordance to present invention brings more possibilities for manufacture of lamp in any length for any specific application, and to have good heat radiation efficiency and a flexibility in power design, along with a long life cycle and the convenience in installation and maintenance. With implementation of the emergency power supply module, the lamp in accordance with present invention may be able to deal with emergency situation, i.e. to work for awhile when in the event of power failure. Furthermore, the end cap comprises an illumination sensor module mounted on the outer end cap, which is able to detect amount of ambient light to control the light source via the elongated printed circuit board. Otherwise, present invention raises the water proof degree, the explosion proof degree to meet the requirement of IP66 standard.

4 Claims, 4 Drawing Sheets

(51) Int. Cl.

| | |
|---|---|
| ***F21V 31/00*** | (2006.01) |
| ***F21V 23/04*** | (2006.01) |
| ***F21V 29/89*** | (2015.01) |
| ***F21V 3/04*** | (2006.01) |
| ***F21V 15/015*** | (2006.01) |
| *F21Y 103/00* | (2016.01) |

(56) References Cited

U.S. PATENT DOCUMENTS

2010/0214785 A1* 8/2010 Chen ..... F21V 7/005
362/267
2010/0271825 A1* 10/2010 Black ..... F21V 31/005
362/267
2012/0162982 A1* 6/2012 Wang ..... F21V 15/013
362/235
2012/0229025 A1* 9/2012 Edwards, Jr. ..... H05B 33/0803
315/35

* cited by examiner

HIGH POWER TRI-PROOF LED LAMP

BACKGROUND OF THE INVENTION

1. Field of the Invention

The invention relative to illumination, in particular, to a high power Tri-proof LED lamp.

2. Description of the Prior Art

Tri-proof lamps refer to incandescent or fluorescent light lamps that are capable of being dust-proof, water-proof, explosion-proof, and rust-proof. Currently, the conventional tri-proof lamp in the market is, constructed by plastic upper and lower PC cover from outside along with sealing elements, and with fluorescent lamps or LED light bars installed inside. Since the covers are made by plastic injection molding machine, the sizes of the covers are therefore limited by the size of the injection molding machine. As a result, manufacturing of tri-proof lamps with length longer than 1.5 m is by far impossible. Meanwhile, due to the implementation of plastic cover, heat transmission is not good. This not only shortens the life cycle of the light source, but also limits the maximum power efficiency of the lamp; normally the maximum power of the lamp is not over than 120 W.

SUMMARY OF THE INVENTION

The objective of present invention is to overcome the drawbacks of prior art and to provide a high power Tri-proof LED lamp.

To achieve aforesaid objective, the invention provides a high power Tri-proof LED lamp, which comprises a lower PC (Polycarbonate) cover, an upper aluminum cover manufactured by extrusion material and relative means and at least one end caps. Each end cap includes an inner end cap, an outer end cap and an illumination sensor. The upper aluminum cover and the lower PC cover are secured with the inner end cap by four inner end cap screws and multiple silica gel posts. In such manner, the aluminum extrusion material of the upper aluminum cover is constructed with PC covers and silica gel posts. The outer end cap is secured with the inner end cap by outer end cap screws. Said upper aluminum cover has an elongated printed circuit board, a light source, a power supply, an emergency power supply module and a securing panel mounted therein. Said securing panel secures the emergency power supply module and the power supply through screws. An upper side of said upper aluminum cover is secured with two back holders by threaded poles. Between the inner end cap and the outer end cap, a wire connector and a sealing pad are mounted. Said wire connector is connected with a water proof wire joint module. Said outer end cap is connected with the terminals through the outer end cap screws. The inner end cap screws and the outer end cap screws are metallic and are capable of assisting heat transmission and dissipation from the covers and the end caps. The illumination sensor module is mounted on the outer end cap, and is able to detect amount of ambient light to control the light source via the elongated printed circuit board. When in a dark environment, the illumination sensor module turns on the light source for environment illumination. When in a bright environment, the illumination sensor module turns off the light source for power saving.

Preferably, said outer end cap has wiring holes formed thereon.

Preferably, an inside of the inner end cap has at least one elastic pad.

Preferably, said water proof wire joint module has a nut mounted thereon.

Comparing with prior art, the advantages that present invention provides are:

1. By using aluminum extrusion material to construct with PC (Polycarbonate) covers and silica gel posts, the length of the lamp is not limited and is extendable, and also meets the requirement of IP66 standard. This brings more possibilities for manufacture of lamp in any length for any specific application.

2. Lamp heat radiation efficiency is good, so that the lamp power can be customizedly designed. Maximally, the power of the lamp can be designed to 250 W/m, so that the lamp is adapted for various applications, like street light, fishing light, mining lamp, tunnel light.

3. Having a long life cycle and the convenience in installation and maintenance 4. With implementation of the emergency power supply module (comprises a charge-discharge circuit, a battery, an indicator), the lamp in accordance with present invention may be able to deal with emergency situation, i.e., to work for a while when in the event of power failure.

These and other objectives of the present invention will no doubt become obvious to those of ordinary skill in the art after reading the following detailed description of the preferred embodiment that is illustrated in the various figures and drawings.

DETAILED DESCRIPTION

A more complete appreciation of the invention, and many of the attendant advantages thereof, will be readily apparent as the same become better understood by reference to the following detailed description when considered in conjunction with the accompanying drawings. It is to be understood that, the described embodiment is intend to further illustrate the invention for better understanding, and are not intended to limit the scope of the invention.

Figure 1:
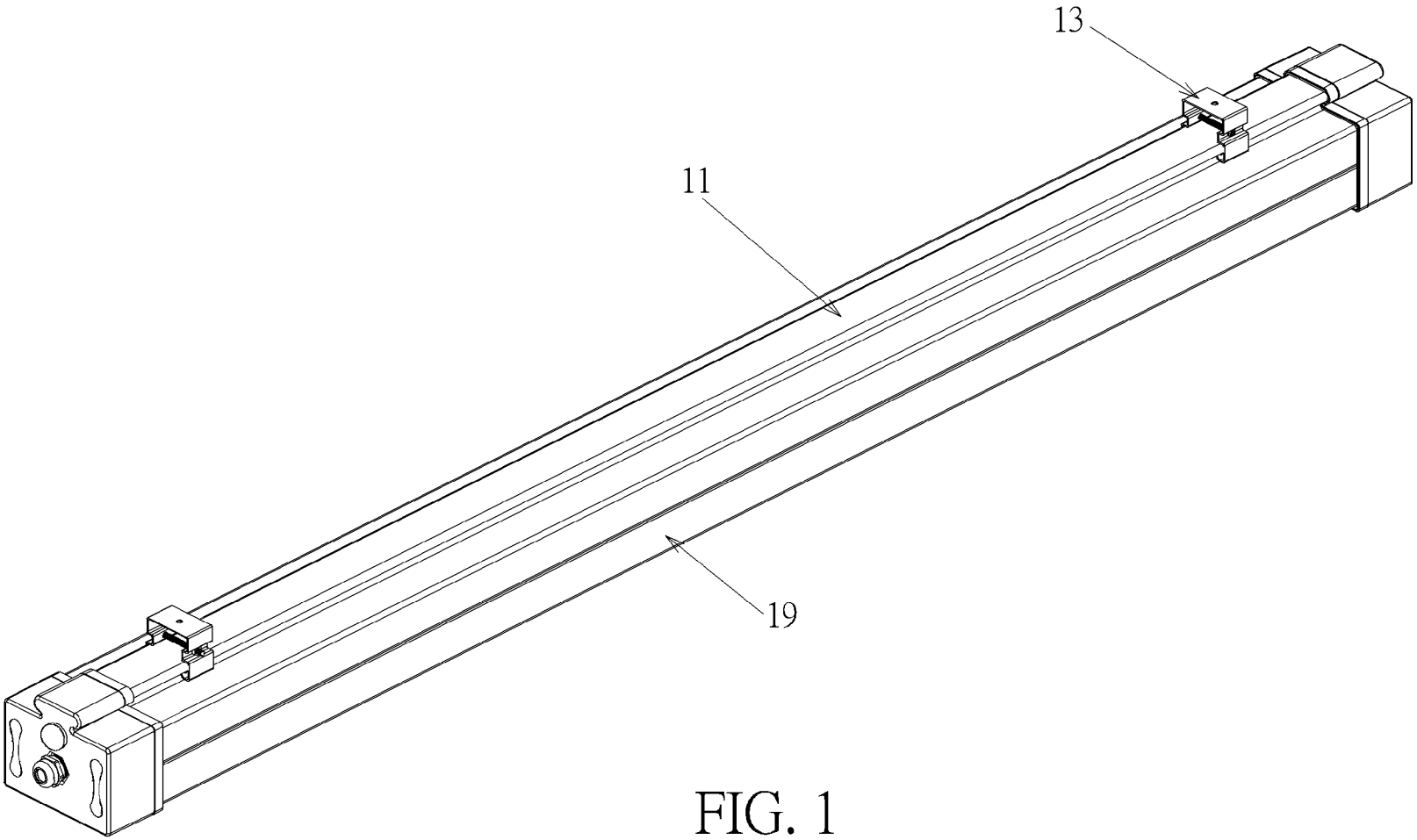
FIG. 1 is a perspective view of a high power Tri-proof LED lamp according to an embodiment of the invention.
Figure 2A:
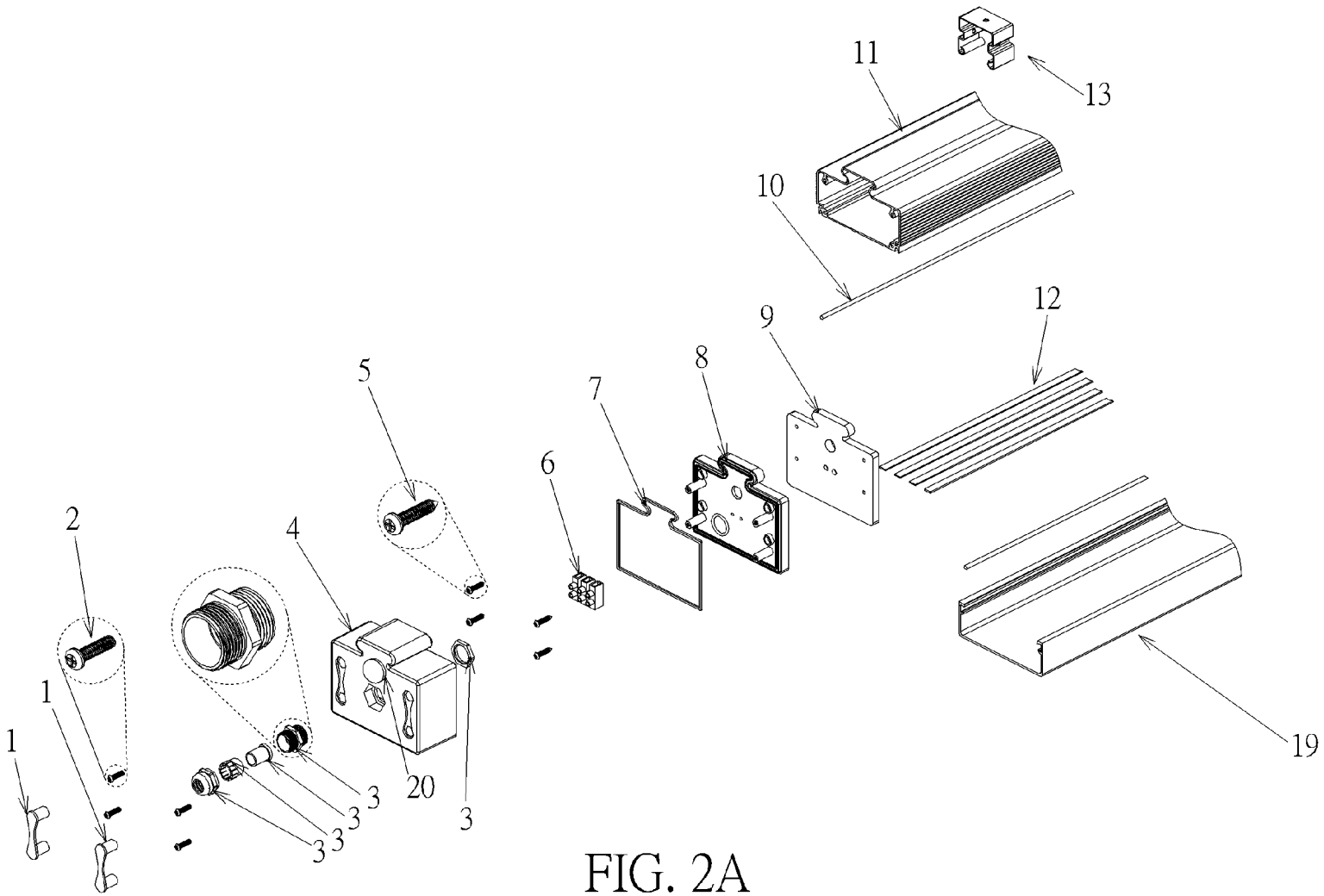
FIG. 2A and FIG. 2B are explosive view of the high power Tri-proof LED lamp according to an embodiment of the invention.
Figure 2B:
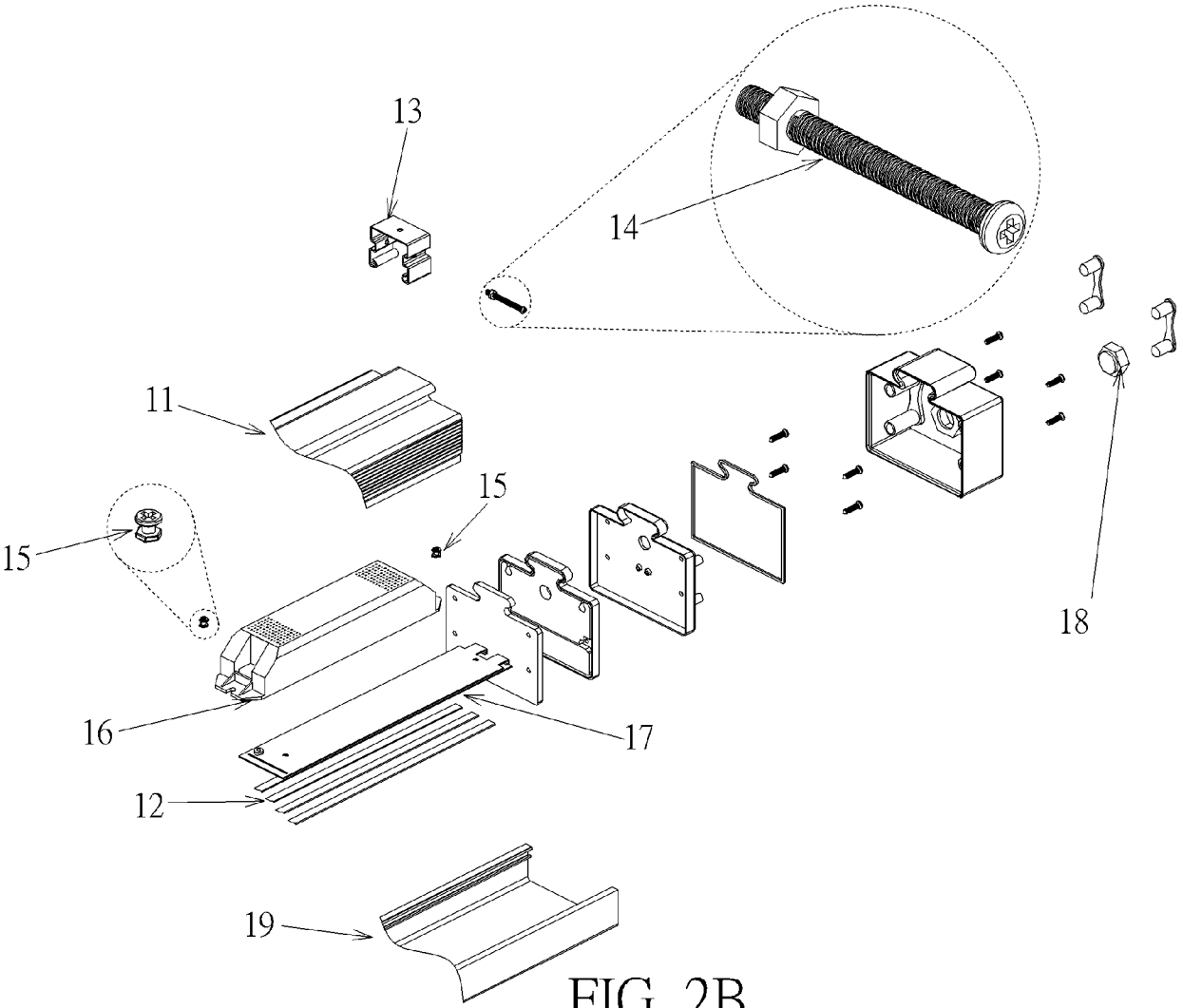
Figure 3:
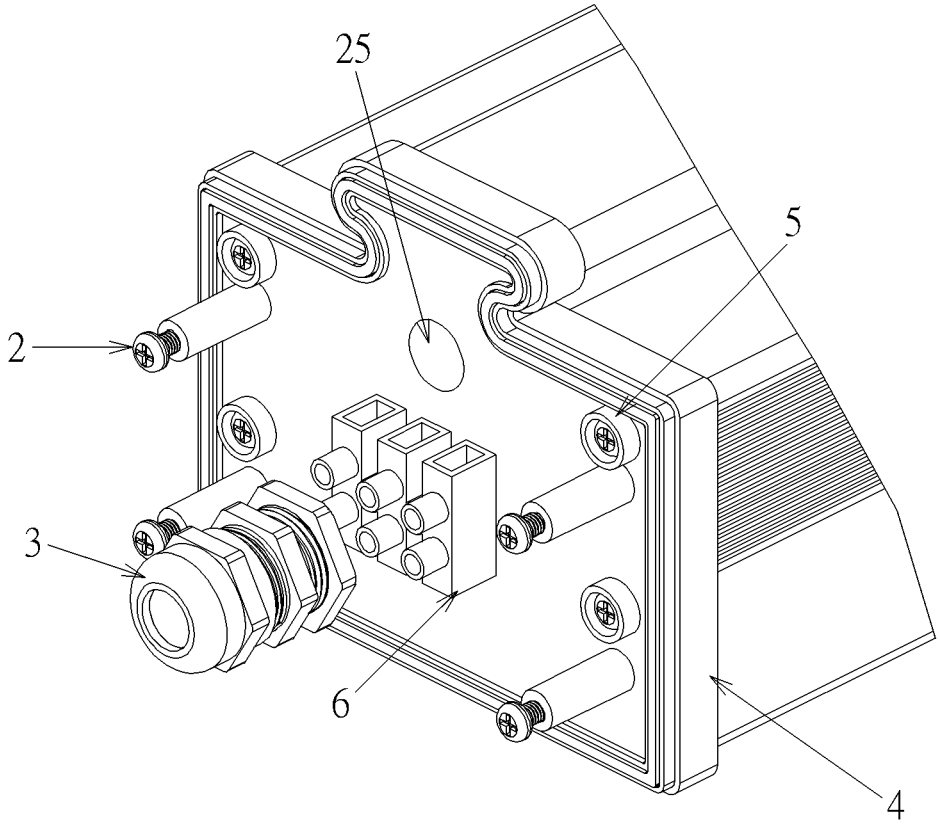
FIG. 3 is a perspective view of the outer cover of the high power Tri-proof LED lamp according to an embodiment of the invention.

As illustrated in FIGS. 1-3, the invention relative to a high power Tri-proof LED lamp, includes a lower PC (Polycarbonate) cover 19, an upper aluminum cover 11 and two end caps. Each end cap includes an inner end cap 8, an outer end cap 4 and an illumination sensor module 20. Said upper aluminum cover 11 and lower PC cover 19 are secured with the inner end cap 8 by four inner end cap screws 5. The outer end cap 4 is secured with the inner end cap 8 by outer end cap screws 2. Said upper aluminum cover 11 has an elongated printed circuit board 10, a light source 12, a power supply, an emergency power supply module 16 and a securing panel 17 mounted therein. Said securing panel 17 secures the power supply and the emergency power supply module 16 through screws 15. The emergency power supply module 16 comprises a charge-discharge circuit, a battery and an indicator. An upper side of said upper aluminum cover 11 is secured with two back holders 13 by threaded poles 14. Between the inner end cap 8 and the outer end cap 4, a wire connector 6 and a sealing pad 7 are mounted. Said wire connector 6 is connected with a water proof wire joint module 3. Said outer end cap 4 is connected with the terminals 1 through the outer end cap screws 2. The illumination sensor module 20 is mounted on the outer end cap 4, and is able to detect amount of ambient light to control the light source 12 via the elongated printed circuit board 10. When in a dark environment, the illumination sensor module 20 turns on the light source 12 for environment illumination. When in a bright environment, the illumination sensor module 20 turns off the light source 12 for power saving.

It is noticed, said outer end cap 4 has wiring holes 25 formed thereon.

It is noticed, an inside of the inner end cap 8 has an elastic pad 9.

It is noticed, said water proof wire joint module 3 has a nut 18 mounted thereon.

The advantages that present invention provides are:

1. By using aluminum extrusion material to construct with PC (Polycarbonate) covers and silica gel posts, the length of the lamp is not limited and is extendable, and also meets the requirement of IP66 standard. This brings more possibilities for manufacture of lamp in any length for any specific application.

2. Lamp heat radiation efficiency is good, so that the power can be customizedly designed. Maximally, the power of the lamp can be designed to 250 W/m, so that the lamp is adapted for various applications, like street light, fishing light, mining lamp, tunnel light.

3. Having a long life cycle and the convenience in installation and maintenance.

4. With implementation of the emergency power supply module (includes a charge-discharge circuit, a battery, an indicator), the lamp in accordance with present invention may be able to deal with emergency situation, i.e. to work for a while when in the event of power failure.

5. By using the illumination sensor module 20, ambient light is detected for better illumination control, so as to effectively balance the power consumption.

It is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A high power Tri-proof LED lamp, comprising:

a lower PC (Polycarbonate) cover;

an upper aluminum cover having an elongated printed circuit board, a light source, a power supply, an emergency power supply module and securing panel mounted therein, said securing panel being secured with the power supply and the emergency power supply module by screws, an upper side of said upper aluminum cover being secured with two back holders by threaded poles; and at least one end cap including an inner end cap and an outer end cap; and an illumination sensor module being mounted on the outer end cap and being able to detect amount of ambient light to control the light source via the elongated printed circuit board;

wherein:

the upper aluminum cover and the lower PC cover are secured with the inner end cap by four inner end cap screws;

the outer end cap is secured with the inner end cap by multiple outer end cap screws;

between the inner end cap and the outer end cap, a wire connector and a sealing pad are mounted, said wire connector being connected with a water proof wire joint module, said outer end cap being connected with terminals through the outer end cap screws.

2. The high power Tri-proof LED lamp as claimed in claim 1, wherein the outer end cap has wiring holes formed thereon.

3. The high power Tri-proof LED lamp as claimed in claim 1, wherein an inside of the inner end cap has at least one elastic pad.

4. The high power Tri-proof LED lamp as claimed in claim 1, wherein the water proof wire joint module has a nut mounted thereon.

* * * * *